US008187030B2

(12) United States Patent
Matsuoka et al.

(10) Patent No.: US 8,187,030 B2
(45) Date of Patent: May 29, 2012

(54) DEVICE CONNECTOR

(75) Inventors: Hiroyuki Matsuoka, Yokkaichi (JP); Daisuke Nakagawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/917,714

(22) Filed: Nov. 2, 2010

(65) Prior Publication Data

US 2011/0104924 A1 May 5, 2011

(30) Foreign Application Priority Data

Nov. 5, 2009 (JP) ..... 2009-254239

(51) Int. Cl.
*H01R 13/73* (2006.01)

(52) U.S. Cl. ..... 439/542; 439/559; 439/566; 439/271

(58) Field of Classification Search ..... 439/542, 439/559, 566
See application file for complete search history.

(56) References Cited

U.S. PATENT DOCUMENTS

| | | | | |
|---|---|---|---|---|
| 6,402,535 | B2 * | 6/2002 | Okabe et al. | 439/157 |
| 6,428,353 | B2 * | 8/2002 | Mochizuki | 439/545 |
| 6,699,069 | B2 * | 3/2004 | Inoue | 439/570 |
| 7,572,150 | B2 | 8/2009 | Matsuoka | |
| 2002/0004326 | A1 * | 1/2002 | Mochizuki | 439/157 |
| 2002/0016100 | A1 * | 2/2002 | Okabe et al. | 439/157 |
| 2011/0104924 | A1 * | 5/2011 | Matsuoka et al. | 439/271 |
| 2011/0117784 | A1 * | 5/2011 | Matsuoka et al. | 439/626 |

* cited by examiner

*Primary Examiner* — James Harvey
(74) *Attorney, Agent, or Firm* — Gerald E. Hespos; Michael J. Porco

(57) ABSTRACT

A device connector has a housing main body (10), a device-side housing portion (12) to be accommodated in a connector mounting hole, a reinforcing plate (30) including an opening (31) for permitting the passage of terminal fittings, and a flange (11) formed by insert molding using the reinforcing plate (30) and synthetic resin, and terminal fittings 15. An outer peripheral end surface of the reinforcing plate (30) is exposed. The device connector is produced with a reduced cost by insert molding using a metal reinforcing plate as an insert while preventing a crack from being created in a synthetic resin portion covering the reinforcing plate (30).

9 Claims, 13 Drawing Sheets

DEVICE CONNECTOR

BACKGROUND OF THE INVENTION

1. Field of the Invention

The invention relates to a connector to be mounted in a case of a device.

2. Description of the Related Art

U.S. Pat. No. 7,572,150 discloses a device connector for connecting a wire-side connector with a device. The wire-side connector is mounted on an end of a wire extending from a power supply. The device is a motor in a metal case of an electric vehicle. The device connector has a housing made of synthetic resin and formed by insert molding using terminal fittings as inserts. The housing is mounted in an aluminum die-cast shell. The die-cast shell has mounting pieces that receive bolts to mount the device connector in the device.

The aluminum die-cast shell of the conventional device connector is strong but costly. Studies in recent years have tried to develop a sufficiently strong cost efficient device connector by molding a resin housing with a metal reinforcing plate as an insert. However, the synthetic resin shrinks more than the reinforcing plate in a cooling process after insert molding due to differences in the coefficients of thermal expansion of the synthetic resin and the metal reinforcing plate. Thus, the synthetic resin covering an outer peripheral end portion of the reinforcing plate is pulled by the synthetic resin covering the opposite surfaces of the reinforcing plate and is likely to crack.

The cracked synthetic resin makes the connector look poor and creates a clearance due to a reduction in adhesion of interfaces of the reinforcing plate and the synthetic resin, and water might enter the connector through this clearance.

In view of the above, it has been considered impractical to mold large connectors of synthetic resin with a metal reinforcing plate as an insert.

The invention was completed in view of the above and an object of the invention is to provide a cost efficient device connector produced by insert molding using a reinforcing plate as an insert while preventing a crack from being created in a synthetic resin portion covering the reinforcing plate.

SUMMARY OF THE INVENTION

The invention relates to a device connector to be mounted to a connector mounting portion in a case of a device. The device connector has a reinforcing plate with one or more device mounting portions to fix the device connector in the connector mounting portion and at least one opening for receiving one or more terminal fittings. The device connector also has a housing formed by insert molding so that synthetic resin covers opposite surfaces of the reinforcing plate. The terminal fittings can be held in the housing while being passed through the opening. The housing is formed to expose an outer peripheral end surface of the reinforcing plate in parts located adjacent to and/or between the device mounting portions.

Layers of the synthetic resin covering the opposite surfaces of the reinforcing plate may shrink when the housing is cooled in a mold. However, synthetic resin is not present on the outer peripheral end surface of the reinforcing plate, and hence there is no synthetic resin to be pulled and cracked as the synthetic resin covering the opposite surfaces of the reinforcing plate shrinks.

An endless ring-shaped seal preferably is provided on a surface of the housing facing the case. The seal surrounds the terminal fittings in a looped manner, and prevents water from penetrating between the case and the device connector.

The device mounting portions may be in one or more mounting pieces projecting from an outer peripheral edge of the reinforcing plate. Accordingly, it is possible to increase spacings between the terminal fittings and easily change the positions of the terminal fittings by enlarging the opening for permitting the passage of the terminal fittings.

A part of the reinforcing plate covered by the synthetic resin of the housing may be formed with one or more anchor grooves. The synthetic resin that covers the reinforcing plate enters the anchor grooves and adheres to the reinforcing plate in shrinking directions. Thus, the synthetic resin covering the reinforcing plate will not shrink in a biased manner, and crack formation in another synthetic resin portion is prevented.

A part of the reinforcing plate covered by the synthetic resin of the housing may have one or more connection holes. The synthetic resin that covers the reinforcing plate enters the connection holes to connect layers of the synthetic resin on the opposite surfaces of the reinforcing plate and to adhere to the reinforcing plate in shrinking directions. Thus, the synthetic resin covering the reinforcing plate will not shrink in a biased manner and crack formation in another synthetic resin portion is prevented.

Outer peripheral end surfaces of the synthetic resin preferably are substantially flush with the outer peripheral end surface of the reinforcing plate.

These and other objects, features and advantages of the invention will become more apparent upon reading the following detailed description and accompanying drawings. Even though embodiments are described separately, single features thereof may be combined to additional embodiments.

DETAILED DESCRIPTION OF THE PREFERRED EMBODIMENTS

Figure 1:
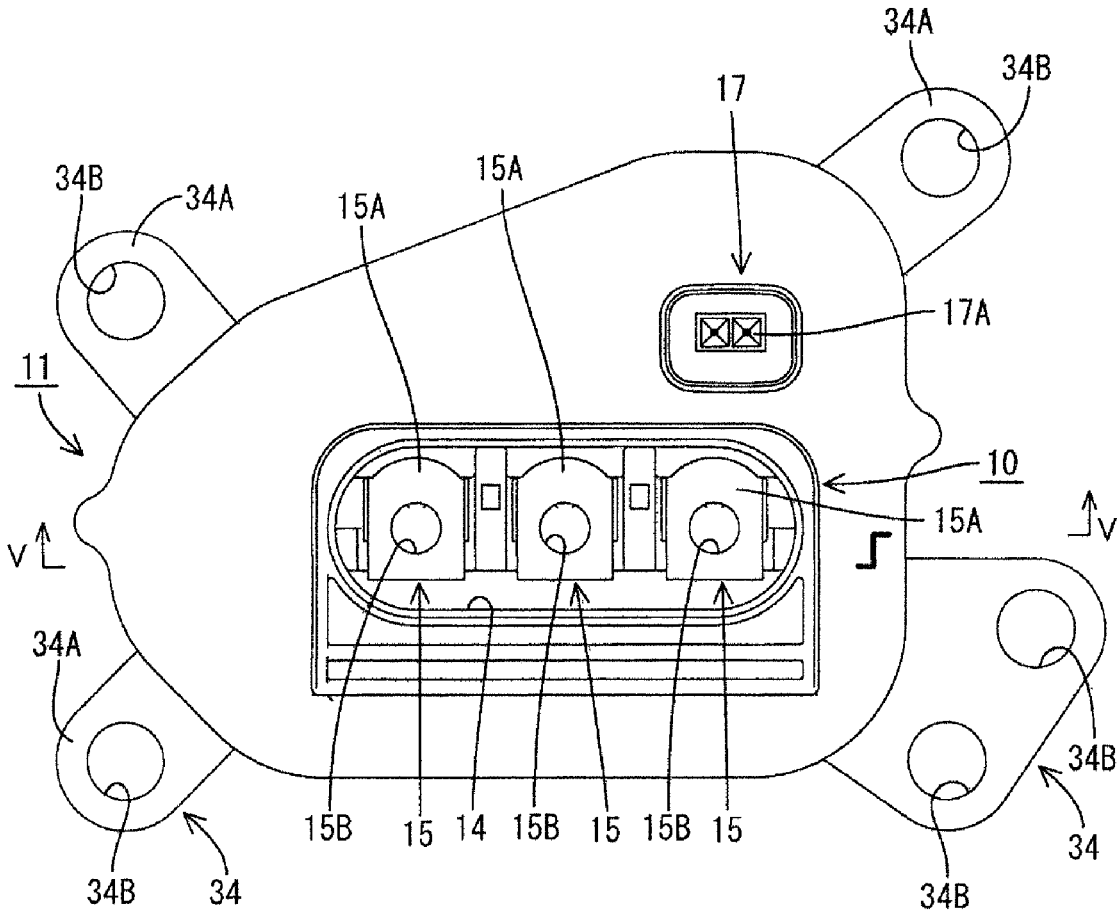
FIG. 1 is a front view of a device connector according to a first embodiment of the invention.
Figure 2:
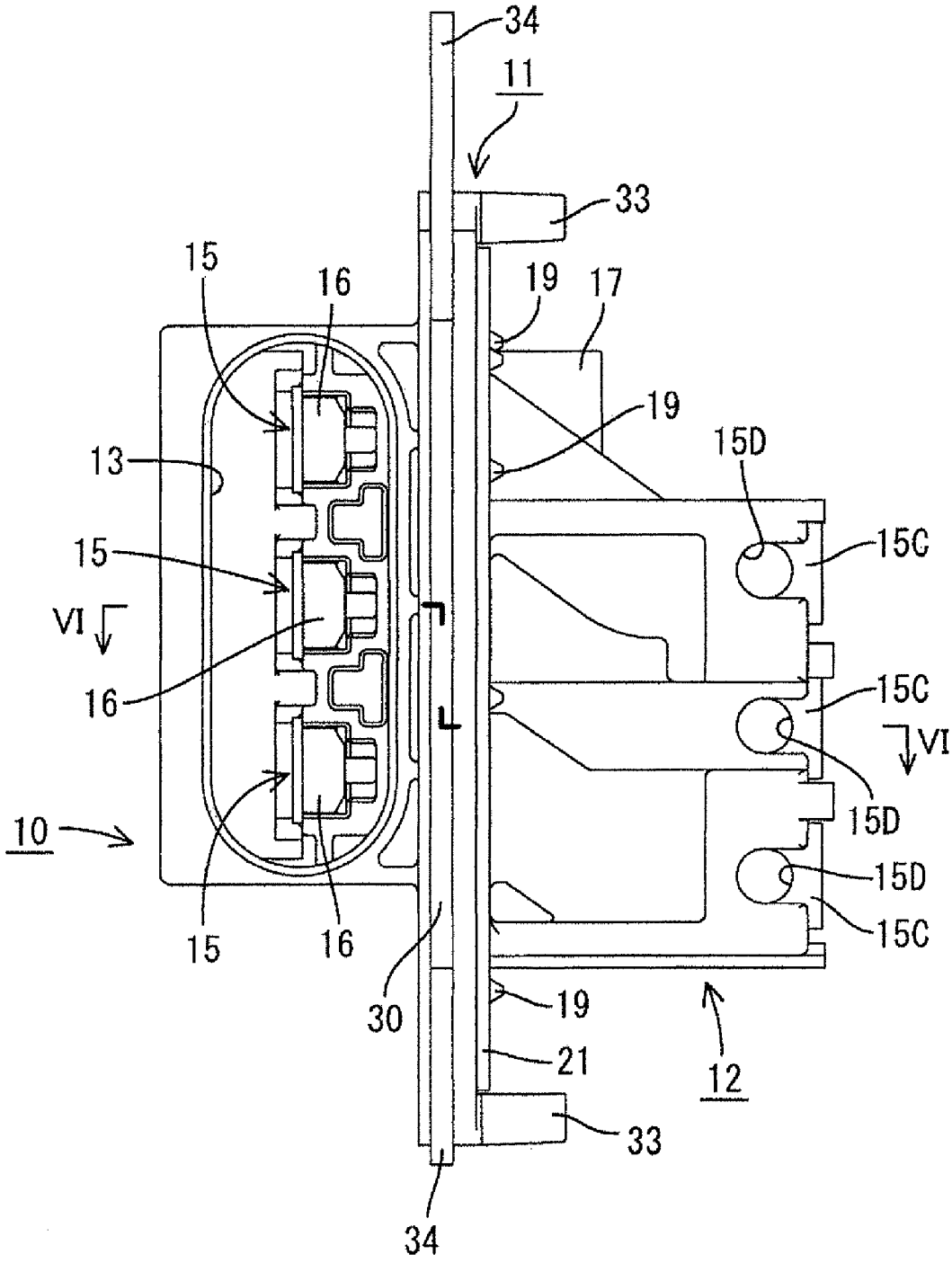
FIG. 2 is a plan view of the device connector.
Figure 3:
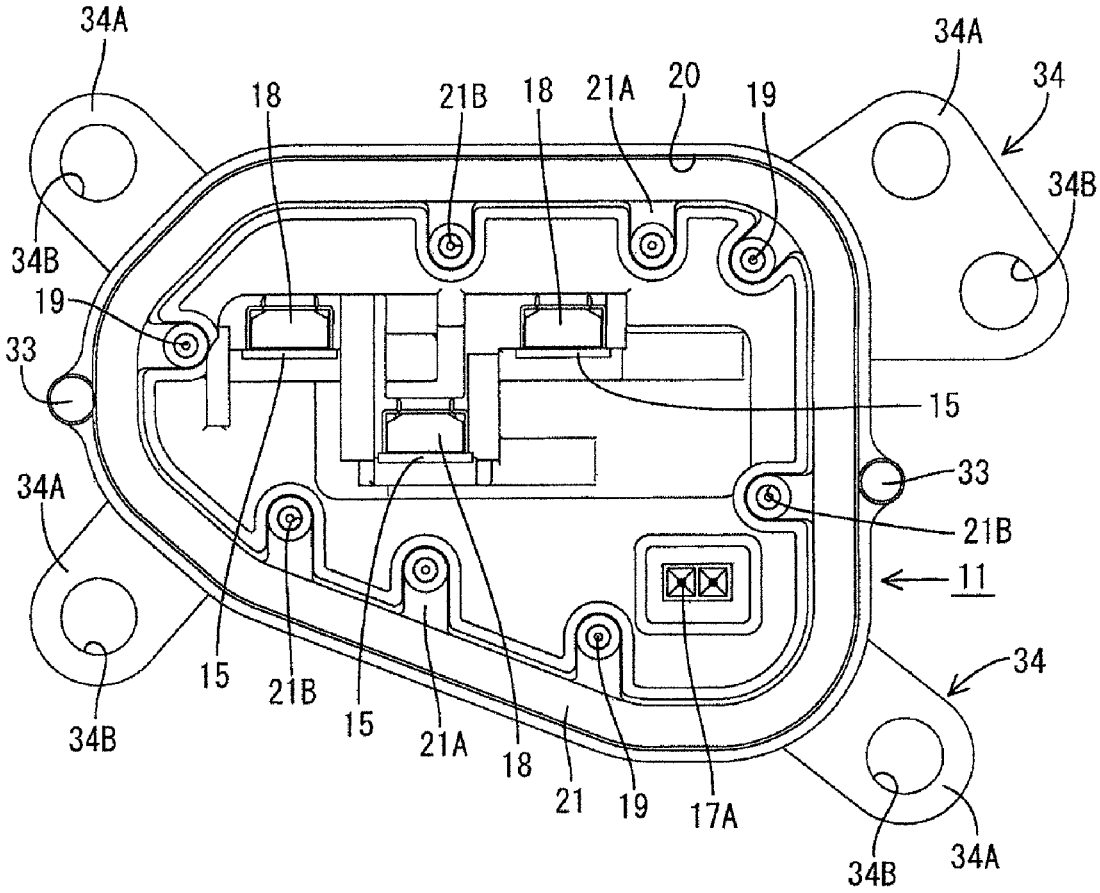
FIG. 3 is a rear view of the device connector.
Figure 4:
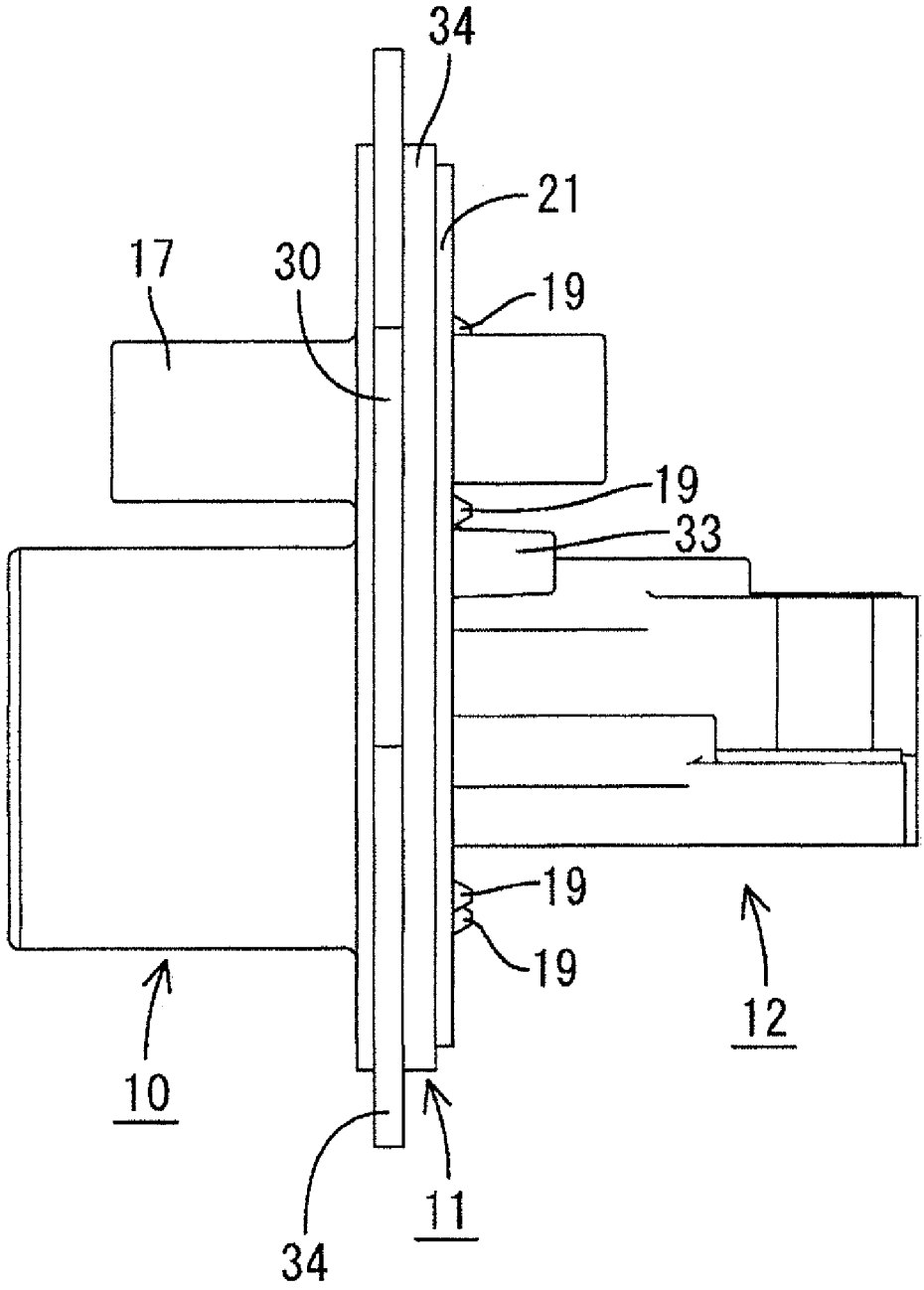
FIG. 4 is a side view of the device connector.
Figure 5:
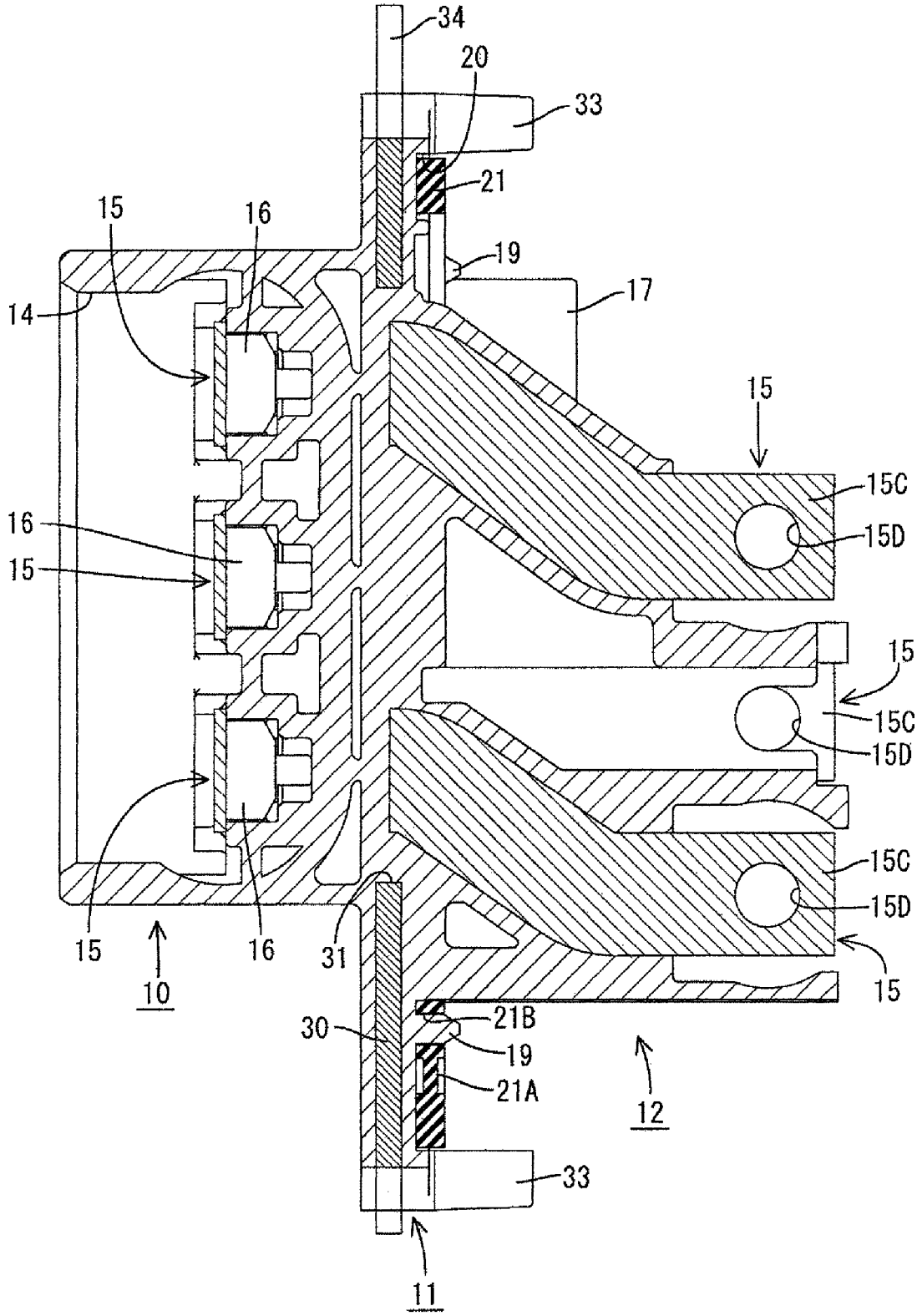
FIG. 5 is a section along V-V of FIG. 1.
Figure 6:
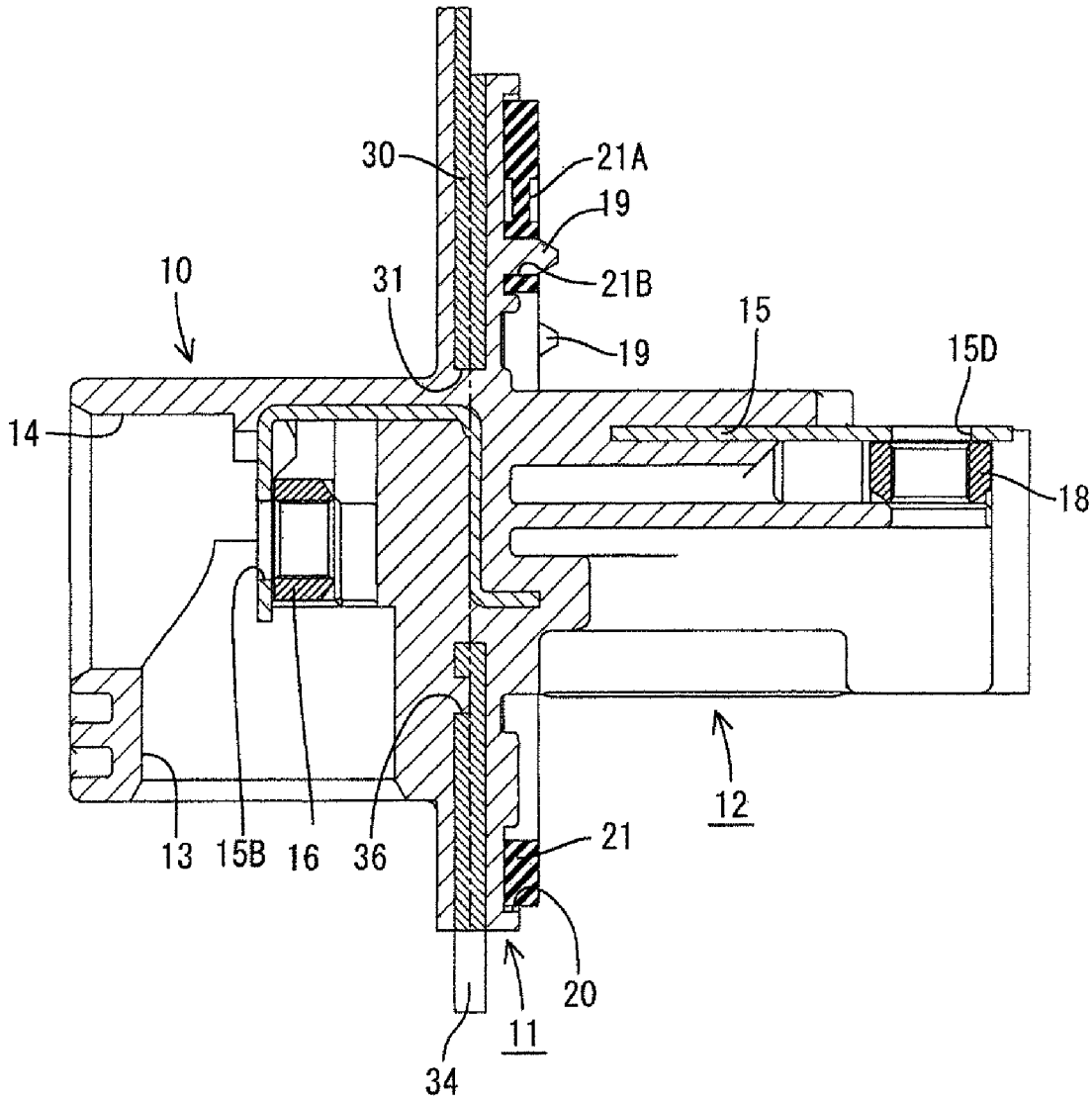
FIG. 6 is a section along VI-VI of FIG. 2.

A device connector according to a first embodiment of the invention is illustrated in FIGS. 1 to 7. The device connector is to be mounted in a connector mounting portion (not shown) provided in a case of a device. An end toward a mating connector and an end toward the connector mounting portion in the case of the device are referred to respectively herein as the front and rear ends in the following description.

As shown in FIGS. 1 to 6, the device connector has a housing main body 10 substantially in the form of a rectangular parallelepiped extending in a forward direction. A flange 11 extends out from the outer peripheral surface of a rear part of the housing main body 10 and is substantially normal to the forward direction. A device-side housing portion 12 extends back from the rear surface of the flange 11 and can be accommodated in a connector mounting hole (not shown) formed e.g. in the case of the device. The housing main body 10, the flange 11 and the device-side housing portion 12 shown here define a connector housing made of synthetic resin.

The housing main body 10 has a fitting portion 13 and a work hole 14. The fitting portion 13 is formed in a side surface of the housing main body 10 substantially extending in a longitudinal direction and wire-side connectors (not shown) mounted on ends of wires can be fit in the fitting portion 13. The work hole 14 is formed in a projecting end surface of the housing main body 10. Terminal fittings 15 are held side by side at stages in the housing main body 10 and have opposite ends extending respectively to the device-side housing portion 12 and toward the fitting portion 13. A wire-side connecting portion 15A is formed in a leading end of each terminal fitting 15 and includes a first bolt hole 15B to be connected to a terminal (not shown) of the wire-side connector. A first nut 16 is mounted in the housing main body 10 on a surface of each wire-side connecting portion 15A facing toward the flange 11 and is substantially continuous with the first bolt hole 15B so that bolt connection can be carried out through the work hole 14.

The flange 11 is formed by insert molding so that a reinforcing plate 30 made of a stiff material having a sufficient mechanical strength (such as metal) is integral to a synthetic resin member while having opposite surfaces at least partly covered by synthetic resin.

Figure 7:
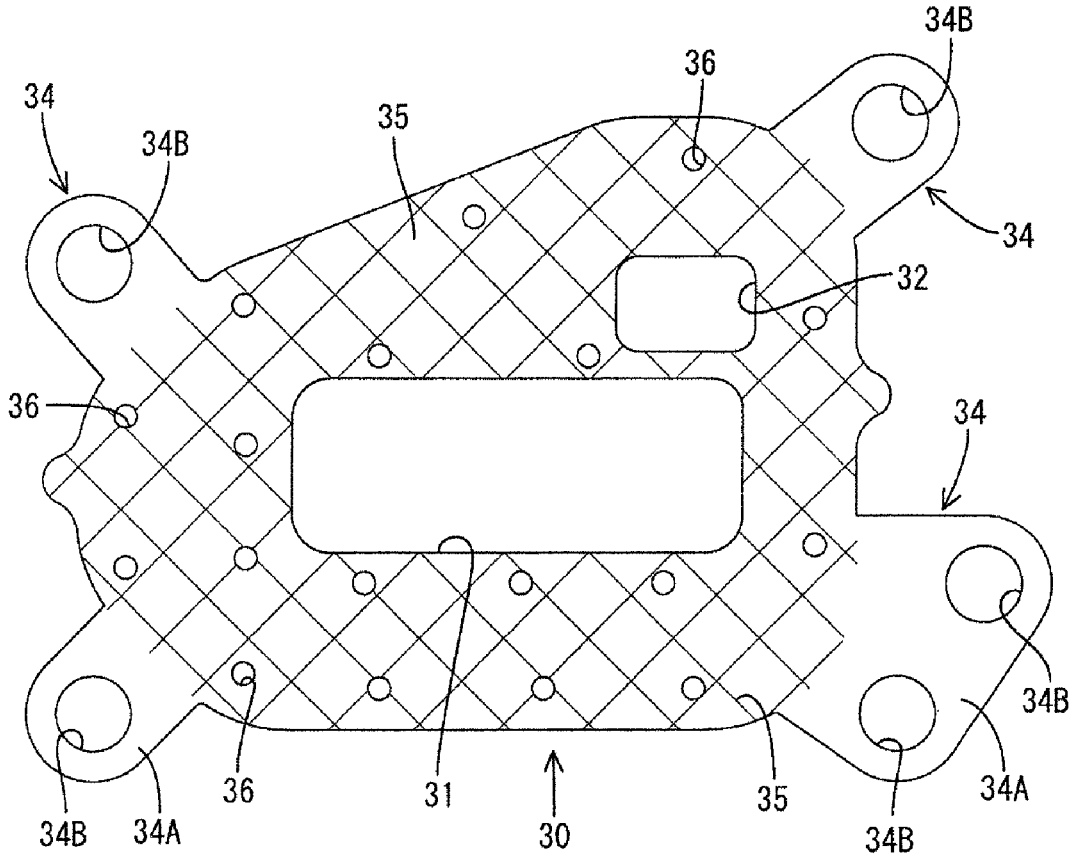
FIG. 7 is a front view of a reinforcing plate showing a state before insert molding.
Figure 8:
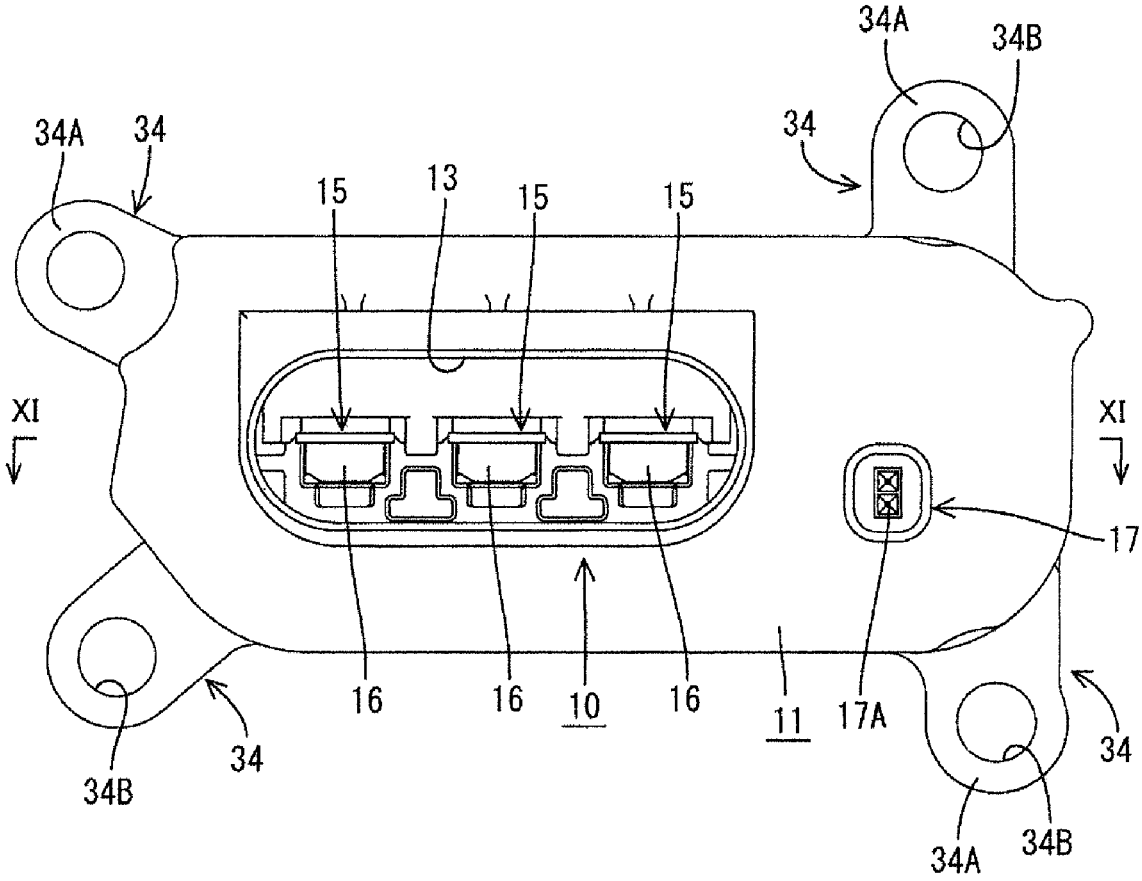
FIG. 8 is a front view of a device connector according to a second embodiment of the invention.
Figure 9:
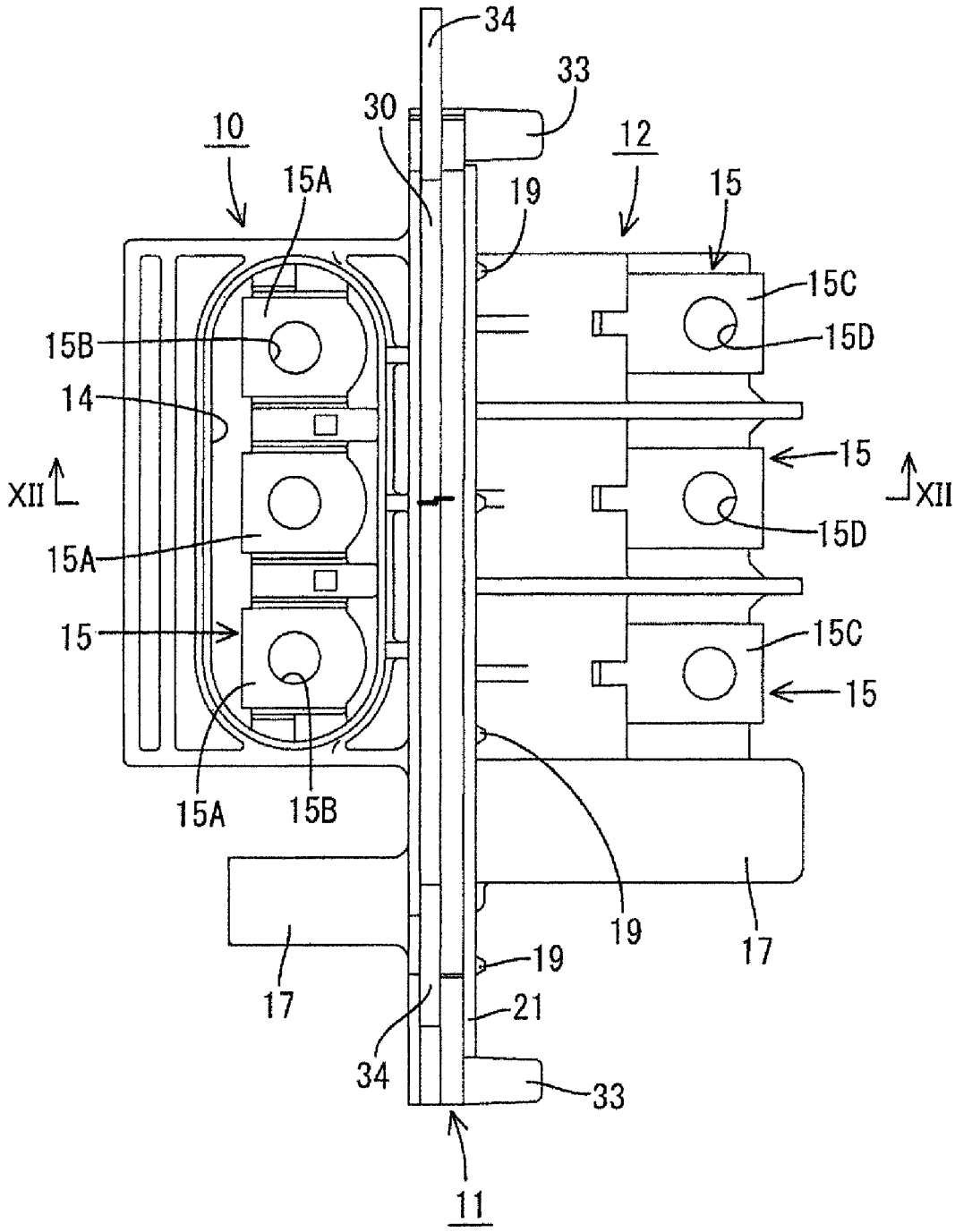
FIG. 9 is a plan view of the device connector.
Figure 10:
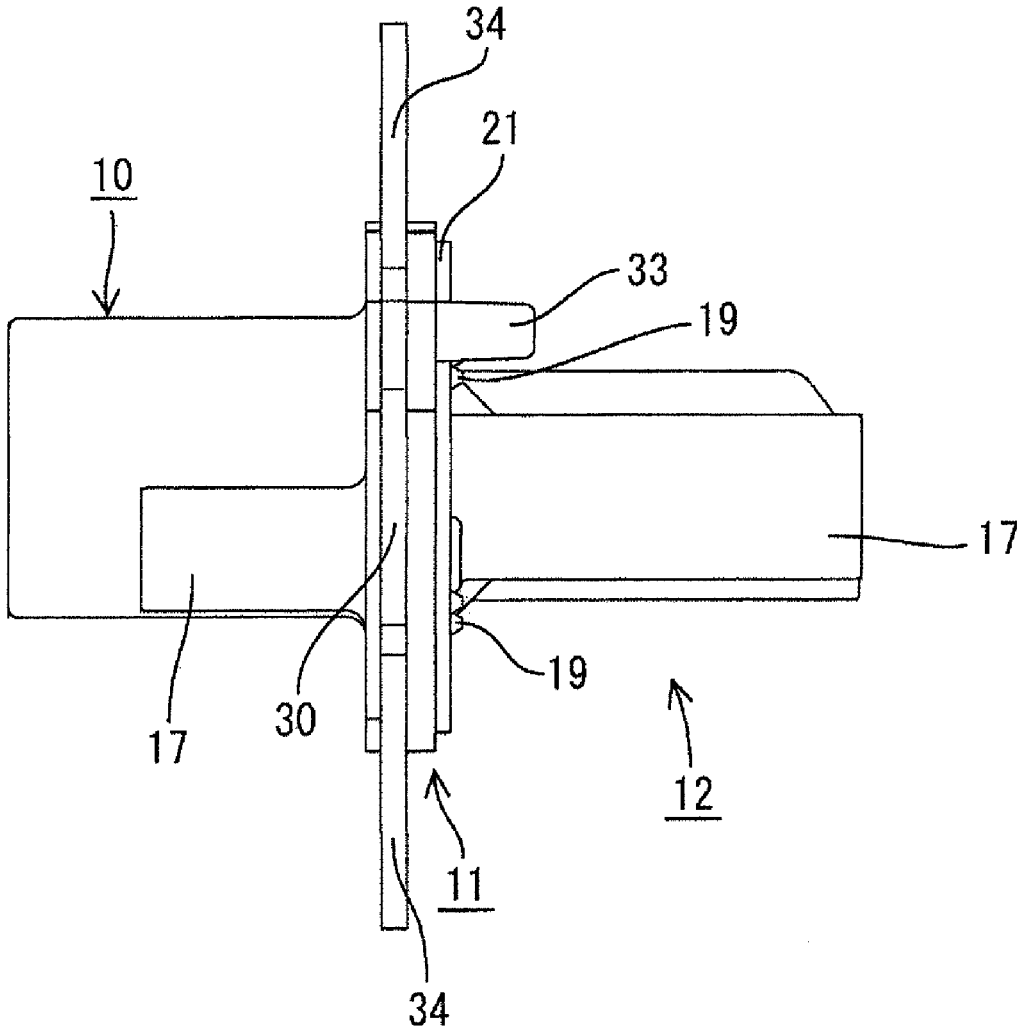
FIG. 10 is a side view of the device connector.
Figure 11:
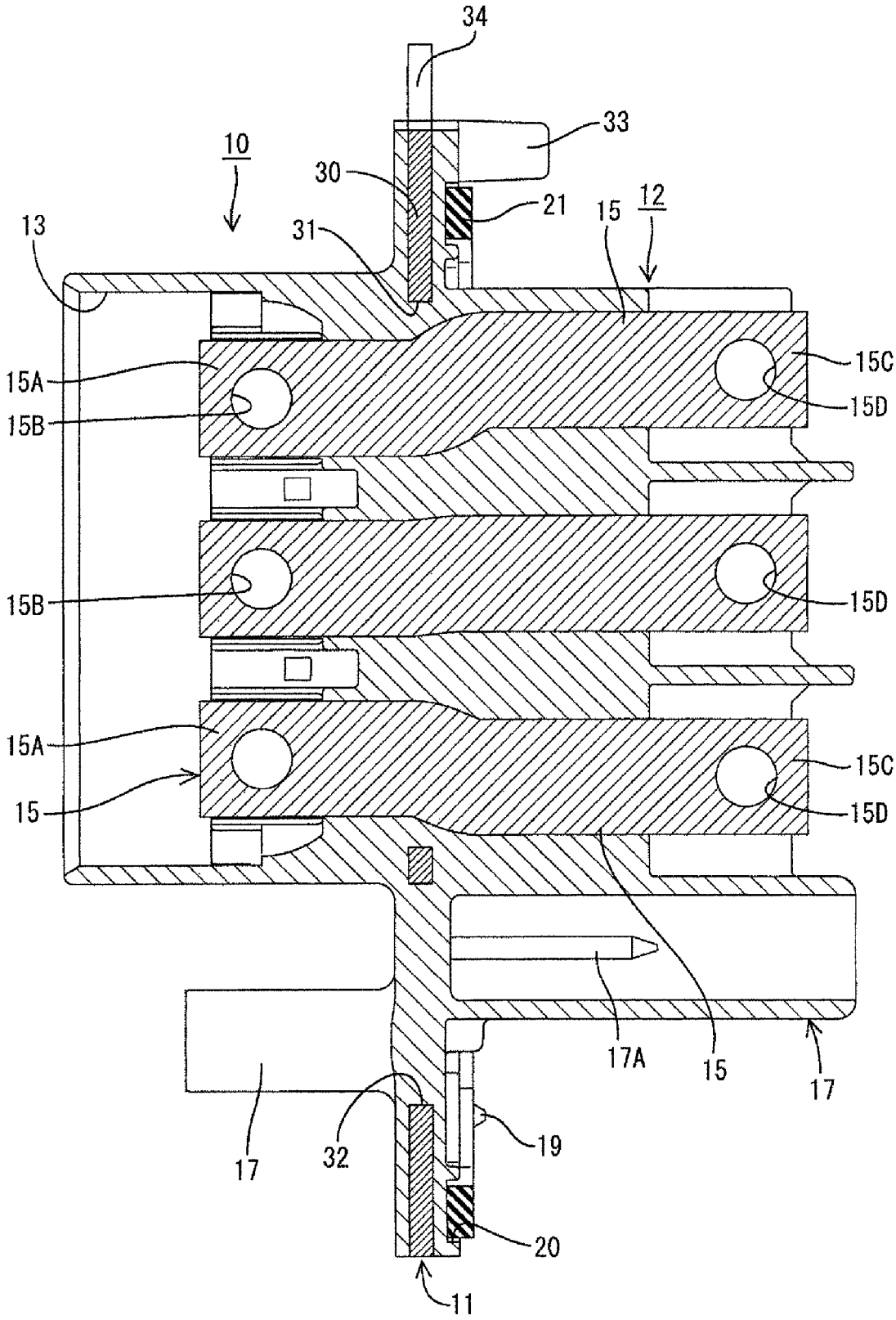
FIG. 11 is a section along XI-XI of FIG. 8.
Figure 12:
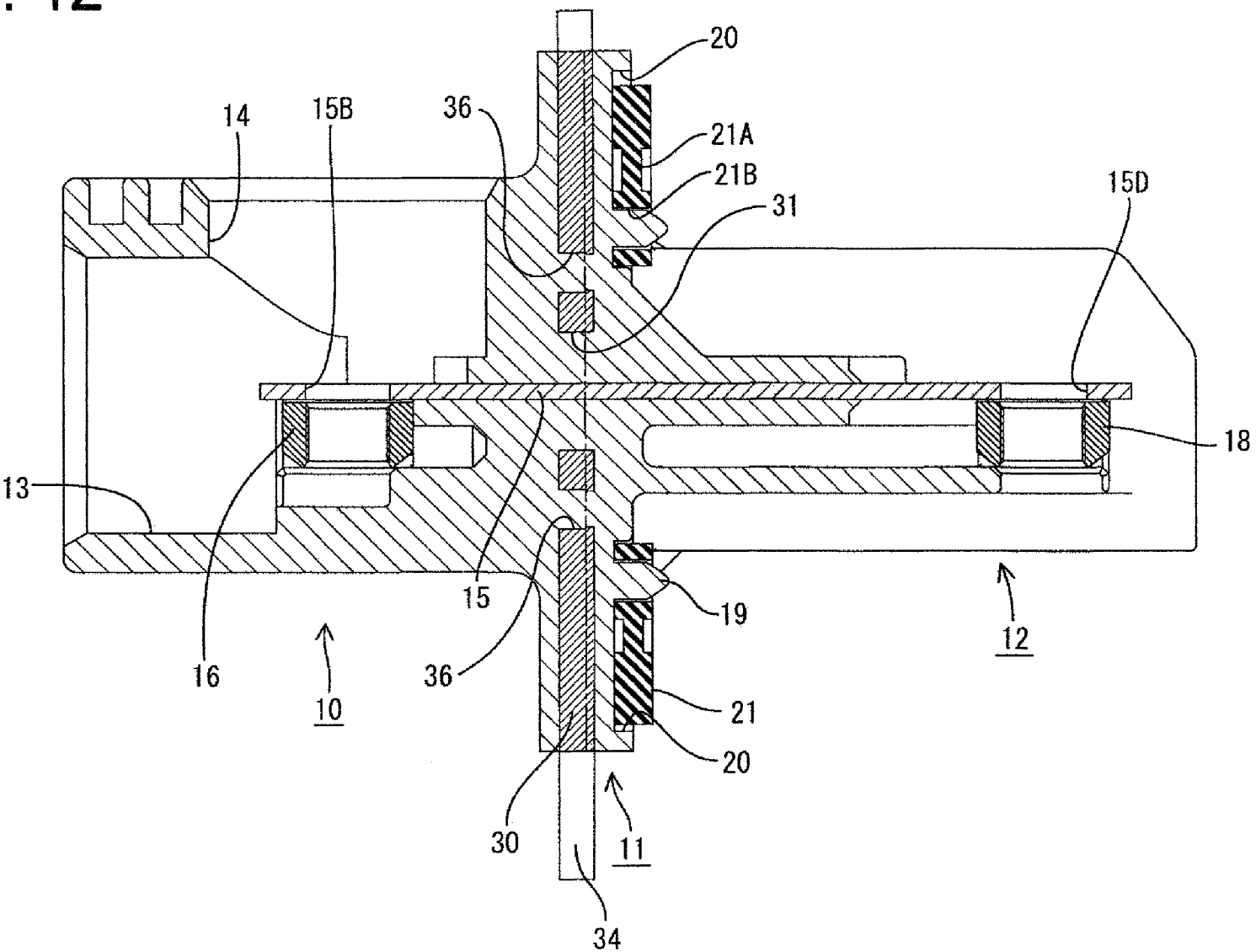
FIG. 12 is a section along XII-XII of FIG. 9.
Figure 13:
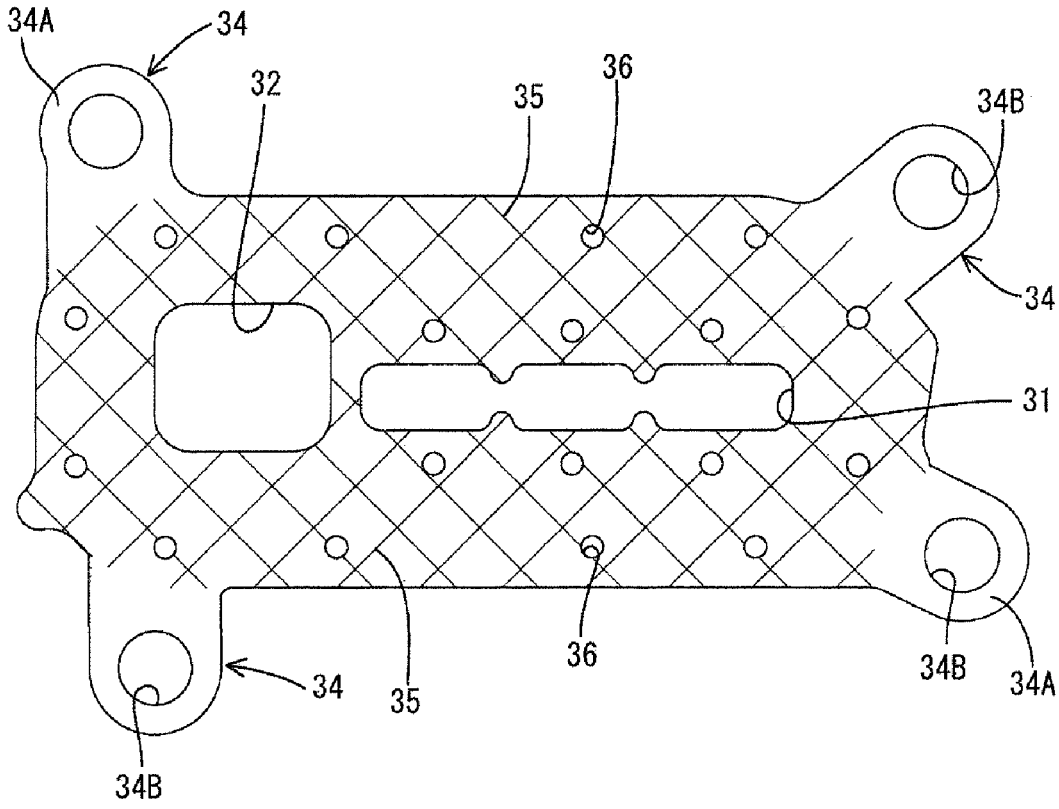
FIG. 13 is a front view of a reinforcing plate showing a state before insert molding.

The reinforcing plate 30 is punched out by a press to define a substantially trapezoidal shape with an one opening 31 for permitting passage of the terminal fittings 15 and an auxiliary opening 32 for permitting passage of a connection detecting terminal, as shown in FIG. 7. The opening 31 has a substantially rectangular shape extending in the longitudinal direction and is in a substantially central part of the reinforcing plate 30. The auxiliary opening 32 is near the opening 31 and near one shorter side of the reinforcing plate 30. The auxiliary opening 32 is substantially rectangular shape and is less than about half (e.g. about ⅓) as wide as the opening 31. The terminal fittings 15 held in the device connector connect the housing main body 10 and the device-side housing portion 12 through the opening 31.

The device-side housing portion 12, positioning pins 33 and an auxiliary housing 17 are formed on the rear surface of the flange 11. The device-side housing portion 12 extends substantially straight back at a position slightly laterally shifted from the housing main body 10. The positioning pins 33 are used for positioning when the device connector is mounted in the case (not shown) of the device. The auxiliary housing 17 extends back at a position offset from the device-side housing portion 12. Thus, the terminal fittings 15 connecting between the housing main body 10 and the device-side housing portion 12 are held in a bent state in the device-side housing portion 12.

The three terminal fittings 15 are held in an isosceles triangle arrangement in the device-side housing portion 12 and extend back from the flange 11. A device-side connecting portion 15C is formed at a leading end of each terminal fitting 15 and has a second bolt hole 15D that can be bolt-connected to a device-side terminal (not shown). Second nuts 18 are mounted in the device-side housing portion 12 substantially continuous with the second bolt holes 15D.

The two positioning pins 33 are at opposite ends of the flange 11 and define cylinders that slightly taper toward the back.

The auxiliary housing 17 also extends forward from the flange 11. A connection detecting terminal 17A passes through the auxiliary opening 32 of the flange 11 and is held in the auxiliary housing 17.

Protuberances 19 project from outer peripheral portions of the rear surface of the flange 11 and a mounting groove 20 extends along the outer peripheral edge of the flange 11. Mounting pieces 34 project from an outer peripheral edge.

The protuberances 19 are at spaced apart positions slightly in from the outer peripheral edge of the flange 11 and the tips of the protuberances 19 taper toward their centers. The mounting groove 20 is located outside the protuberances 19 and a sealing member 21 is mounted therein. The sealing member 21 is formed with flange-side mounting portions 21A each of which has a mounting hole 21B at a position substantially corresponding to the protuberance 19. The protuberances 19 of the flange 11 are inserted into the mounting holes 21B of the sealing member 21 as the sealing member 21 is mounted into the mounting groove 20 of the flange 11.

The mounting pieces 34 extend from the reinforcing plate 30 at four corner positions of the flange 11 in such a manner to expose their metal surfaces. Each mounting piece 34 has a device mounting portion 34A with a bolt insertion hole 34B.

The outer peripheral edge of the flange 11 between the mounting pieces 34 is formed to expose the reinforcing plate 30, and outer peripheral edges of the synthetic resin that covers the opposite surfaces of the reinforcing plate 30 are substantially flush with the outer peripheral edge of the reinforcing plate 30.

Anchor grooves 35 are formed to define net-like array in the opposite surfaces of the reinforcing plate 30 covered by the synthetic resin, and connection holes 36 penetrate through or into the reinforcing plate 30 at positions spaced from inner and outer peripheral edges of the reinforcing plate 30.

The device connector of this embodiment is constructed as described above. Here is described a shrinkage deformation when the synthetic resin member is cured during insert molding.

Differences in the coefficients of thermal expansion the synthetic resin and the metal of the reinforcing plate 30 causes the synthetic resin to shrink more than the metal reinforcing plate 30 when the resin is cured by cooling during insert molding. The synthetic resin parts that cover a large area of the reinforcing plate 30 will shrink more. In this regard, the synthetic resin covering the opposite surfaces of the reinforcing plate 30 has a large area and hence shrinks to a large extent. As a result, the outer peripheral edges of the synthetic resin are pulled toward the housing main body 10 and the device-side housing portion 12. However, the outer peripheral edge of the flange 11 is not covered by the synthetic resin and accordingly there are no synthetic resin portions subjected to excessive strain due to shrinkage. As a result, there are no areas the synthetic resin that will be pulled from the opposite sides to create a crack.

A second embodiment of the invention is described with reference to FIGS. 8 to 13. A device connector of the second embodiment has functions and effects similar to those of the above first embodiment, and is to be mounted in a connector mounting portion (not shown) provided in a case of a device similar to the first embodiment.

The device connector of the second embodiment has a housing main body 10 and a device-side housing portion 12 on opposite sides of a substantially rectangular flange 11. The positions of a fitting portion 13 and a work hole 14 in the housing main body 10 are switched or inverted and terminal fittings 15 are held in to extend substantially straight back.

The three terminal fittings 15 held in the device-side housing portion 12 are arranged substantially side by side. Thus, the terminal fittings 15 connecting the housing main body 10 and the device-side housing portion 12 extend substantially on the same plane although being slightly bent in the device-side housing portion 12.

An auxiliary housing 17 extends in forward and backward directions via the flange 11 and is formed such that surfaces thereof before the flange 11 and those after the flange 11 are shifted somewhat laterally. A connection detecting terminal 17A held in the auxiliary housing 17 also is bent according in the auxiliary housing 17.

A reinforcing plate 30 is located in the flange 11 and has a substantially rectangular plate shape similar to the flange 11. A substantially rectangular opening 31 is formed at an intermediate position in the reinforcing plate 30 for permitting passage of the terminal fittings. Further, an auxiliary opening 32 is laterally offset from the opening 31. The other construction is similar to or substantially same as in the first embodiment.

Coefficients of thermal expansion cause the synthetic resin covering the opposite surfaces of the reinforcing plate 30 in the second embodiment to pull synthetic resin located at an outer peripheral edge of the flange 11 toward the housing main body 10 and the device-side housing portion 12 during cooling after insert molding. However, at least an outer peripheral end surface of the flange 11 is not covered by synthetic resin and, hence, no synthetic resin is strained excessively by shrinkage. Therefore there is no likelihood of creating a crack.

The invention is not limited to the above described and illustrated embodiments. For example, the following embodiments are also included in the technical scope of the present invention.

The opening 31 for permitting the passage of the terminal fittings is a hole formed by the closed inner peripheral edge of the reinforcing plate 30 in the above embodiments. However, the invention is not limited to such a mode and the opening 31 may be an opening in an open state.

The terminal fittings 15 are connected by bolts in the above embodiments. However, the invention is not so limited and may be, for example, male terminal fittings to be connected to female terminal fittings provided in the wire-side connector.

The connection holes 36 are formed in the inner and outer peripheral edge portions in the above embodiments. However, the connection holes 36 may be formed only in the inner or outer peripheral edge portion of the reinforcing plate 30 or may be formed at a plurality of other positions or no connection holes may be formed.

The connection detecting terminal 17A is mounted in the above embodiments. However, a connection detecting terminal 17A is not required.

The particularly net-like anchor grooves 35 are formed in the opposite surfaces of the reinforcing plate 30 in the above embodiments. However, the invention is not limited to such a mode and, for example, anchor grooves may be formed in stripes or broken lines or no anchor grooves may be formed in the opposite surfaces of the reinforcing plate 30.

The outer peripheral end surface of the reinforcing plate 30 is exposed over the entire circumference from the synthetic resin in the above embodiments. However, a part or several parts of the outer peripheral end surface of the reinforcing plate little influenced by the shrinkage of the synthetic resin may be covered by the synthetic resin.

What is claimed is:

1. A device connector, comprising:

a reinforcing plate including at least one device mounting portion for fixing the device connector to a mounting portion and having at least one opening;

a housing formed by insert molding such that synthetic resin at least partly covers opposite surfaces of the reinforcing plate; and at least one terminal fitting held in the housing and passing through the opening, wherein the housing is formed as to expose an outer peripheral edge of the reinforcing plate, and the housing has an endless ring shaped sealing member surrounding the terminal fittings in a looped matter.

2. The device connector of claim 1, wherein the device mounting portion is provided in a mounting piece projecting from an outer peripheral edge of the reinforcing plate.

3. The device connector of claim 1, wherein the reinforcing plate has at least one anchor groove in a part covered by the synthetic resin of the housing, the synthetic resin being anchored in the anchor groove.

4. The device connector of claim 1, wherein the reinforcing plate is formed with at least one connection hole connecting layers of the synthetic resin on opposite surfaces of the reinforcing plate.

5. The device connector of claim 1, wherein outer peripheral edges of the synthetic resin on the reinforcing plate are substantially flush with the outer peripheral edge of the reinforcing plate.

6. A device connector, comprising:

a reinforcing plate having opposite first and second surfaces and an outer peripheral edge extending between the opposite first and second surfaces, and connection holes formed through the reinforcing plate from the first surface to the second surface;

a housing formed from a unitary matrix of synthetic resin and having a main body projecting from the first side of the reinforcing plate, a device-side housing portion projecting from the second side of the reinforcing plate and a flange projecting out from the main body and the device-side housing portion, the synthetic resin of the flange engaging the first and second surfaces of the reinforcing plate and extending unitarily through the connection holes, the synthetic resin of the flange being substantially flush with the outer peripheral edge of the reinforcing plate so that the outer peripheral edge of the reinforcing plate is exposed.

7. The device connector of claim 6, wherein the reinforcing plate further has at least one opening, the device connector further comprising at least one terminal fitting held in the housing and passing through the opening.

8. The device connector of claim 7, wherein the reinforcing plate further has a plurality of device mounting portions projecting out from the flange and having bolt insertion holes for fixing the device connector to a support.

9. The device connector of claim 7, wherein the reinforcing plate has first and second arrays of anchor grooves formed respectively in the first and second surfaces, the synthetic resin being anchored in the anchor grooves.

* * * * *